US007828000B2

(12) United States Patent
Lee

(10) Patent No.: US 7,828,000 B2
(45) Date of Patent: Nov. 9, 2010

(54) COSMETICS VESSEL

(75) Inventor: Young-Joo Lee, Anyang-Si (KR)

(73) Assignee: LG Household & Health Care Ltd. (KR)

( * ) Notice: Subject to any disclaimer, the term of this patent is extended or adjusted under 35 U.S.C. 154(b) by 204 days.

(21) Appl. No.: 12/086,931

(22) PCT Filed: Feb. 23, 2006

(86) PCT No.: PCT/KR2006/000637

§ 371 (c)(1),
(2), (4) Date: Jun. 20, 2008

(87) PCT Pub. No.: WO2007/097480

PCT Pub. Date: Aug. 30, 2007

(65) Prior Publication Data

US 2009/0032052 A1 Feb. 5, 2009

(30) Foreign Application Priority Data

Feb. 22, 2006 (KR) ..... 10-2006-0017305

(51) Int. Cl.
*A45D 33/20* (2006.01)
*B65D 69/00* (2006.01)

(52) U.S. Cl. ..... 132/287; 132/294; 132/304; 132/316; 206/235; 206/581; 220/345.4

(58) Field of Classification Search ..... 206/235, 206/581, 468, 818; 132/287, 294–297, 301, 132/304, 314, 316; 220/345.1, 345.4, 345.5
See application file for complete search history.

(56) References Cited

U.S. PATENT DOCUMENTS

| | | | | |
|---|---|---|---|---|
| 1,453,563 | A * | 5/1923 | Albert | 132/294 |
| 1,662,065 | A * | 3/1928 | Kendall | 132/287 |
| 4,932,547 | A | 6/1990 | Rodriguez | |
| 4,944,402 | A * | 7/1990 | Wu | 206/581 |
| 5,337,890 | A | 8/1994 | Lai | |
| 2004/0129599 | A1 * | 7/2004 | Yi-Hung | 206/581 |

FOREIGN PATENT DOCUMENTS

| | | |
|---|---|---|
| JP | 2001-252130 A | 9/2001 |
| JP | 2001-269217 A | 10/2001 |

* cited by examiner

*Primary Examiner*—Luan K Bui
(74) *Attorney, Agent, or Firm*—Lerner, David, Littenberg, Krumholz & Mentlik, LLP

(57) ABSTRACT

A cosmetic case is provided. The cosmetic case includes: a first casing having a first container; a second casing which is connected with the first casing in a sliding manner, opens and closes the first container, and has a second container; and a third casing which is connected with the second casing, and opens and closes the second container, wherein, when the first container is open by sliding the second casing with respect to the first casing, the third casing is lifted at the same time, thereby opening the second container.

28 Claims, 10 Drawing Sheets

COSMETICS VESSEL

BACKGROUND OF THE INVENTION (a) Field of the Invention

The present invention relates to a cosmetic case, and more particularly, to a cosmetic case capable of easily opening and closing containers therein.

(b) Description of the Related Art

Cosmetic containers contain cosmetics, such as compacts, eye-shadows, two-way cakes, or powders along with puffs for a user to conveniently use the cosmetics.

With the improvement of portability of cosmetics, more people wear a make-up while using transportation, walking, or doing other tasks in their everyday lives.

However, in a conventional cosmetic case, the user has had to inconveniently open and close the cosmetic case, and it has not been easy to wear a make-up while viewing a mirror. Thus, wearing a make-up at the same time of taking care of other tasks has been difficult. Further, when the cosmetic case includes a plurality of containers, the containers have had to be open and closed inconveniently one by one.

In addition, the conventional cosmetic case has not been user-friendly to the physically challenged, since it is almost impossible to open and close the cosmetic case with one hand alone.

SUMMARY OF THE INVENTION

The present invention provides a cosmetic case which can be conveniently open and closed with a simple operation.

According to an aspect of the present invention, there is provided a cosmetic case comprising: a first casing having a first container; a second casing which is connected with the first casing in a sliding manner, opens and closes the first container, and has a second container; and a third casing which is connected with the second casing, and opens and closes the second container, wherein, when the first container is open by sliding the second casing with respect to the first casing, the third casing is lifted at the same time, thereby opening the second container.

In the aforementioned aspect of the present invention, the first casing may comprise a lower bottom, and a lower sidewall vertically extended from edge portions of the lower bottom, the second casing may comprise an upper bottom, and an upper sidewall vertically extended from edge portions of the upper bottom, and the third casing may comprise a cover main body covering the second container of the second casing and a cover sidewall that extends from edge portions of the cover main body, to be inserted into the second container.

In addition, a mirror may be attached to front side of the cover main body of the third casing.

In addition, the first casing may further comprise a first guide rail and a first guide bar, the second casing may further comprise a second guide rail and a second guide bar, and the third casing may be connected with the second guide rail, and the second guide bar may be connected with the first guide rail.

In addition, the first guide bar and the second guide bar may be respectively formed at both opposite sides with respect to a direction where the first casing and the second casing slide with respect to each other.

In addition, the second guide bar may comprise a protrusion, which is protruded from the edge portions of the upper bottom of the second casing towards the lower sidewall of the first casing, and a hook which is bent-extended from an end of the protrusion.

In addition, the first guide rail may comprise a protrusion inserting portion through which the protrusion is inserted and a hook snag where the hook is snagged.

In addition, the first guide bar may comprise a rod, which is protruded from the lower sidewall of the first casing towards the upper bottom of the second casing, and a snag axis which is protruded-extended from an end of the rod towards a direction normal to a lengthwise-direction of the second guide rail.

In addition, the second guide rail may comprise a rod inserting portion through which the rod is inserted and an axis guide notch through which the snag axis is inserted.

In addition, the second casing may further comprise a pair of rotation axes which face each other and are protruded from inner lateral surface of the second container, and the third casing 30 may further comprise an axis container which is formed at one end of the cover sidewall and is connected with the rotation axes.

In addition, the third casing may further comprise a lift rail formed at the cover sidewall parallel with respect to the direction where the first casing and the second casing slide each other, and the snag axis of the first guide bar may pass through the axis guide notch of second guide rail and may be connected with the lift rail.

In addition, when the first guide bar of the first casing moves along the second guide rail of the second casing, and thus the first container is open, the snag axis of the first guide bar may move along the lift rail of the third casing at the same time, and the third casing may rotate about the axis container, thereby opening the second container.

In addition, when the first guide bar of the first casing moves along the second guide rail of the second casing, and thus the first container is closed, the snag axis of the first guide bar may move along the lift rail of the third casing at the same time, and the third casing may rotate about the axis container, thereby closing the second container.

In addition, a distance between the lift rail of the third casing and the upper bottom of the second casing may gradually change.

In addition, in the lift rail, a portion farthest from the axis container may be the farthest from the upper bottom.

In addition, a release aperture may be formed at the edge portions of the lift rail, so that the snag axis of the first guide bar connected with the lift rail can be released from the lift rail.

In addition, the release aperture may be formed in the lift rail at an edge portion farthest from the axis container.

In addition, when the third casing rotates about the axis container, and thus the second container is open, the mirror may have a specific inclination angle.

In addition, the mirror may have an inclination angle in the range of 30 to 70 degrees with respect to the upper bottom of the second casing.

In addition, the cosmetic case may further comprise an elastic member which is contained in the second container, and may provide a repulsive force between the second casing and the third casing.

In addition, the elastic member may be a torsion coil spring.

In addition, the third casing may further comprise a snag notch formed in the cover sidewall parallel to the direction where the first casing and the second casing slide each other, at a position farthest from the container.

In addition, the snag axis of the first guide bar may pass through the axis guide notch of the second guide rail and may be snagged by the snag notch in a state that the first container is closed, and when the first casing and the second casing slide each other, and thus the first container is open, the snag axis may be released from the snag notch.

In addition, when the holding axis is released from the holding notch, the third casing may be lifted while rotating about the container, and the second container may be open.

In addition, the second casing may further comprise a stopper, and the stopper may limit the rotation of the third casing.

In addition, when the third casing rotates about the axis container, and thus the second container is open, the mirror may have a specific inclination angle.

In addition, the mirror may have an inclination angle in the range of 30 to 70 degrees with respect to the upper bottom of the second casing.

In addition, a magnetic member may be attached to a portion of the upper bottom of the second casing and a portion of the lower sidewall of the first casing facing the upper bottom in a state that the first container is closed.

In addition, a magnetic member may be attached to a portion of the upper sidewall of the second casing and a portion of the cover sidewall of the third casing facing the portion of the upper sidewall.

In addition, the first container may contain a powder.

In addition, the second container may contain a puff.

Accordingly, the user can easily open and close the containers, and wear a make-up while viewing the mirror conveniently.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
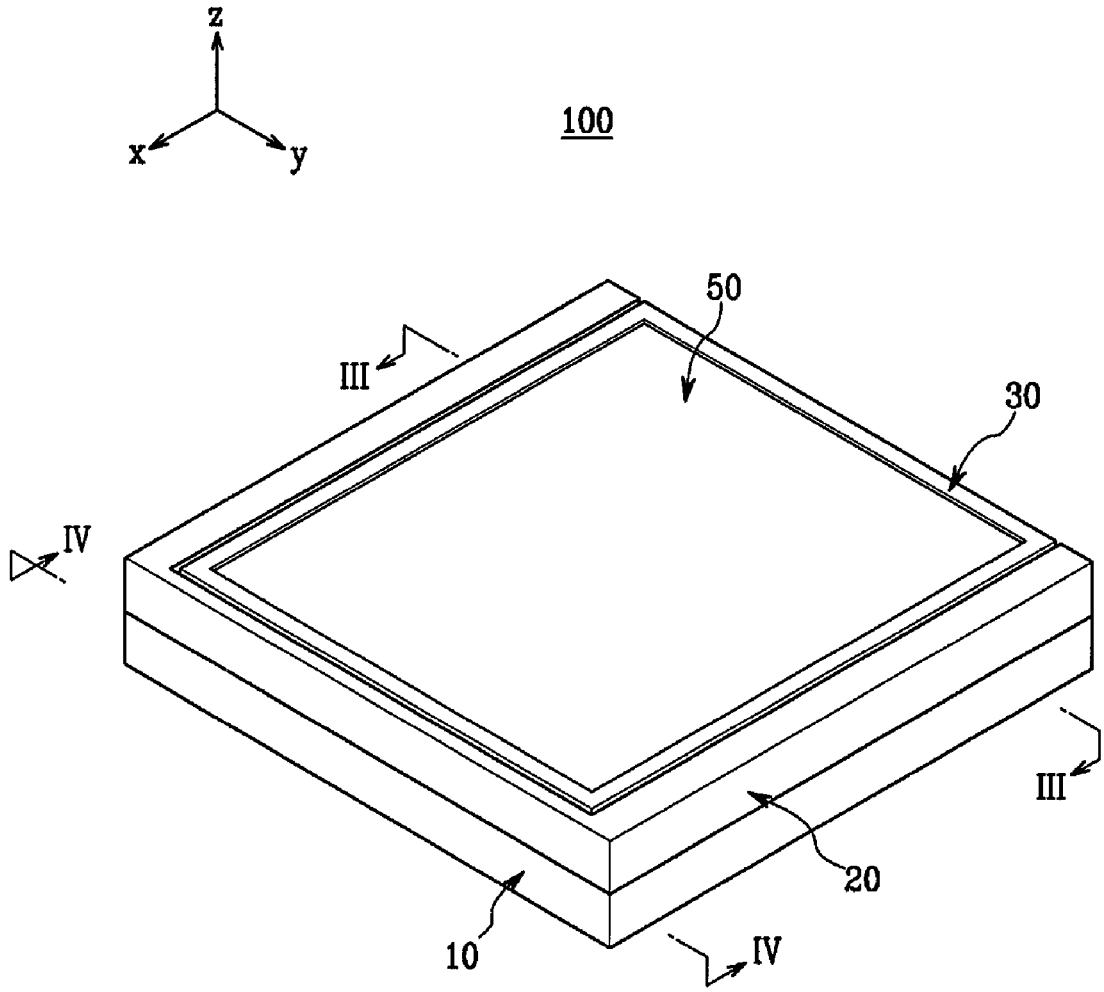
FIGS. 1 and 2 are perspective views of a cosmetic case according to a first embodiment of the present invention.

Hereinafter, exemplary embodiments of the present invention will be described in detail with reference to the attached drawings. The exemplary embodiments should be considered in descriptive sense only and not for purposes of limitation. For clarity, unnecessary descriptions will be omitted, and like reference numerals in the drawings denote like or similar elements.

In a first embodiment among a plurality of embodiments, like elements having the same structure will be described by using the like reference numerals, and in other embodiments, only structures different from the first embodiment will be described.

Figure 2:
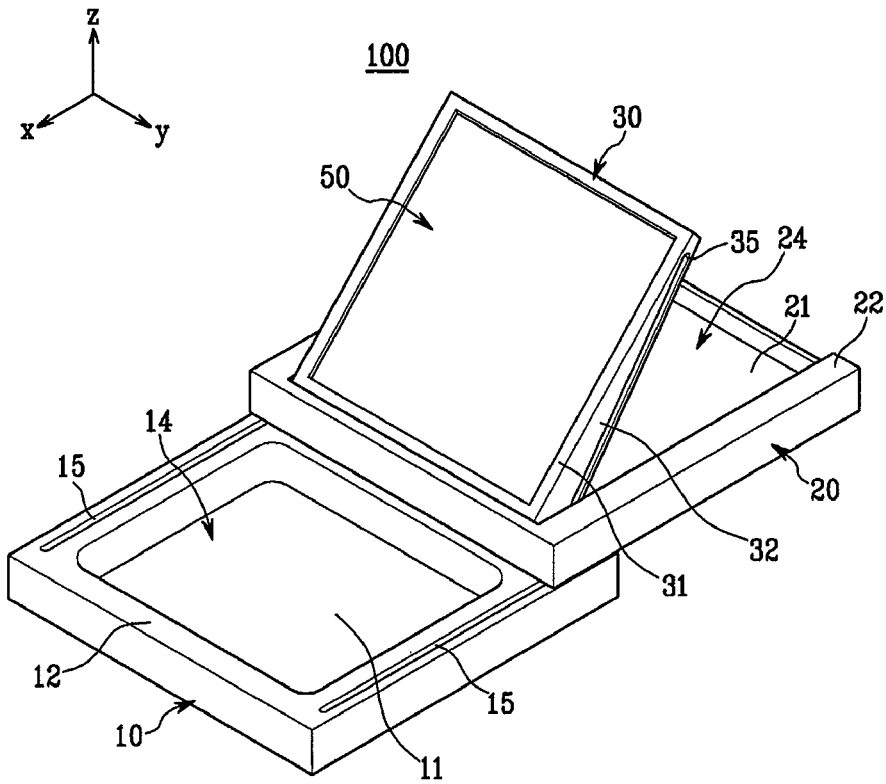

FIGS. 1 and 2 show a cosmetic case 100 according to a first embodiment of the present invention.

Referring to FIG. 1, the cosmetic case 100 includes a first casing 10, a second casing 20 formed above the first casing 10, a third casing 30 covering the second casing 20, and a mirror 50 attached to front side of the third casing 30.

Referring to FIG. 2, the first casing 10 includes a lower bottom 11, a lower sidewall 12 vertically extended from edge portions of the lower bottom 11, and a first container 14 formed by the lower bottom 11 and the lower sidewall 12.

The second casing 20 includes an upper bottom 21, an upper sidewall 22 vertically extended from edge portions of the upper bottom 21, and a second container 24 formed by the upper bottom 21 and the upper sidewall 22.

Here, the second casing 20 is connected with the first casing 10 in a sliding manner. While the second casing 20 slides with respect to the first casing 10, the upper bottom 21 of the second casing 20 opens and closes the first container 14 of the first casing 10.

The third casing 30 includes a cover main body 31 covering the second container 24 of the second casing 20 and a cover sidewall 32 that extends from edge portions of the cover main body 31, to be inserted into the second container 24. When the third casing 30 covers the second container 24 of the second casing 20, the outer surface of the cover sidewall 32 faces the inner surface of the upper sidewall 22. Here, when the first container 14 is open by sliding the second casing 20 with respect to the first casing 10, the third casing 30 is lifted at the same time, thereby opening the second container 24. The mirror 50 is attached to front side of the cover main body 31 of the third casing 30.

Figure 3:
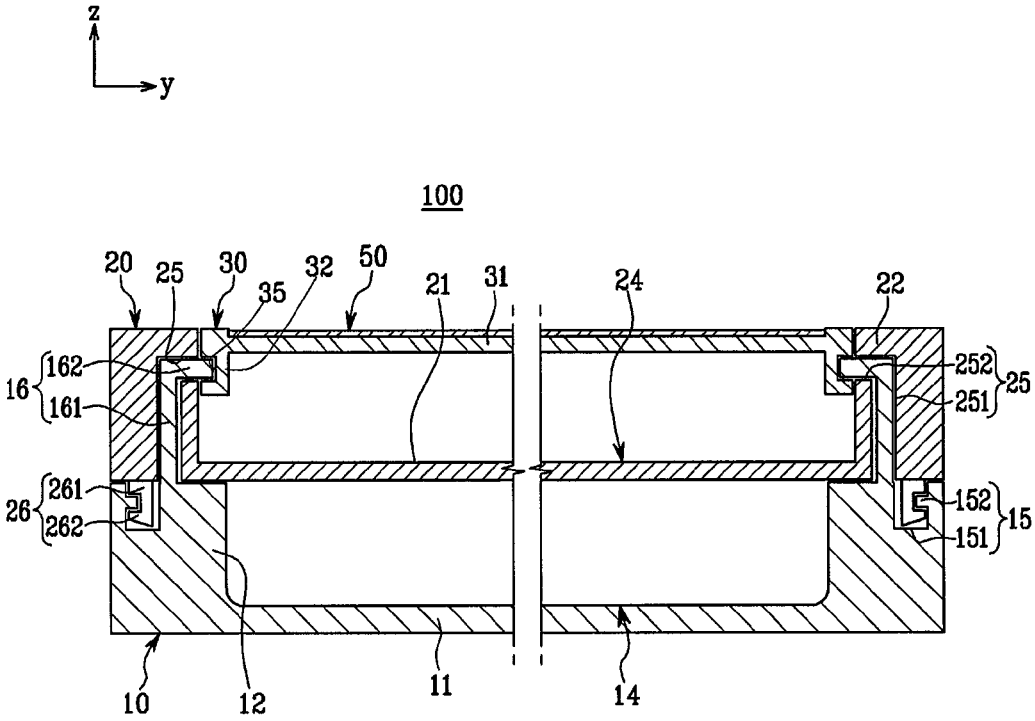
FIG. 3 is a cross-sectional view cut along the III-III line of FIG. 1.
Figure 4:
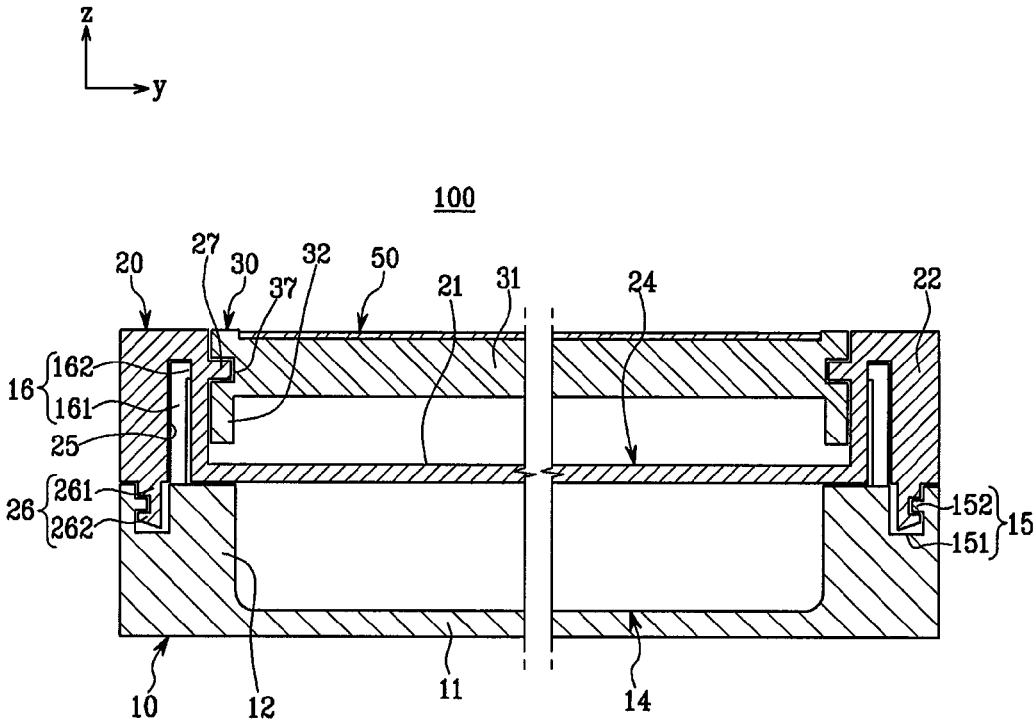
FIG. 4 is a cross-sectional view cut along the IV-IV line of FIG. 1.

FIGS. 3 and 4 are cross-sectional views cut along the III-III line and the IV-IV line of FIG. 1, respectively. Now, a connection structure of the first casing 10, the second casing 20, and the third casing 30 will be described in detail with reference to FIGS. 3 and 4.

Referring to FIG. 3, the first casing 10 further includes a first guide rail 15 and a first guide bar 16, and the second casing 20 further includes the second guide rail 25 and the second guide bar 26. Here, the first guide bar 16 is connected with the second guide rail 25, and the second guide bar 26 is connected with the first guide rail 15. Accordingly, the first casing 10 and the second casing 20 slide with respect to each other.

The first guide bar 16 and the second guide bar 26 are respectively formed at both opposite sides with respect to a direction (X-axis direction) where the first casing 10 and the second casing 20 slide with respect to each other. In other words, when the first container 14 of the first casing 10 is closed, the first guide bar 16 and the second guide bar 26 are respectively located at both opposite ends of the first guide rail 15 and the first guide bar 16.

The second guide bar 26 includes a protrusion 261, which is protruded from the edge portions of the upper bottom 21 of the second casing 20 towards the lower sidewall 12 of the first casing 10, and a hook 262 which is bent-extended from an end of the protrusion 261. In other words, the hook 262 extends from the end of the protrusion 261 towards a direction (Y-axis direction) where a protrusion direction of the protrusion 261 and the X-axis direction are crossed respectively.

The first guide rail 15 includes a protrusion inserting portion 151 through which the protrusion 261 of the second guide bar 26 is inserted and a hook snag 252 where the hook 262 of the second guide bar 26 is snagged. Further, the first guide rail 15 has a length in the X-axis direction.

The first guide bar 16 includes a rod 161, which is protruded from the lower sidewall 12 of the first casing 10 towards the edge portions of the upper bottom 21 of the second casing 20, and a snag axis 162 which is protruded-extended from an end of the rod 161 towards a direction (Y-axis direction) normal to a lengthwise-direction of the second guide rail 25.

The second guide rail 25 includes a rod inserting portion 251 through which the rod 161 of the first guide bar 16 is inserted and an axis guide notch 252 through which the snag axis 162 of the first guide bar 16 is inserted. Further, the second guide rail 25 is parallel to the first guide rail 15.

According to the structure above, the first guide bar 16 is connected with the second guide rail 25, and moves along the second guide rail 25, whereas the second guide bar 26 is connected with the first guide rail 15, and moves along the first guide rail 15. Therefore, the second casing 20 is connected with the first casing 10 in a sliding manner.

Referring to FIG. 4, the second casing 20 further includes a pair of rotation axes 27 which face each other and are protruded from inner lateral surface of the second container 24. The third casing 30 further includes an axis container 37 which is formed at one end of the cover sidewall 32 and is rotatably connected with the rotation axes 27 of the second casing 20. Accordingly, the third casing 30 opens and closes the second container 24 of the second casing 20, while rotating about the container 37 with respect to the rotation axes 27.

As shown in FIG. 3, the third casing 30 further includes a lift rail 35 formed at the cover sidewall 32 parallel with respect to the X-axis direction. Here, the snag axis 162 of the first guide bar 16 passes through the axis guide notch 252, and one end of the snag axis 162 is connected with the lift rail 35.

Figure 5:
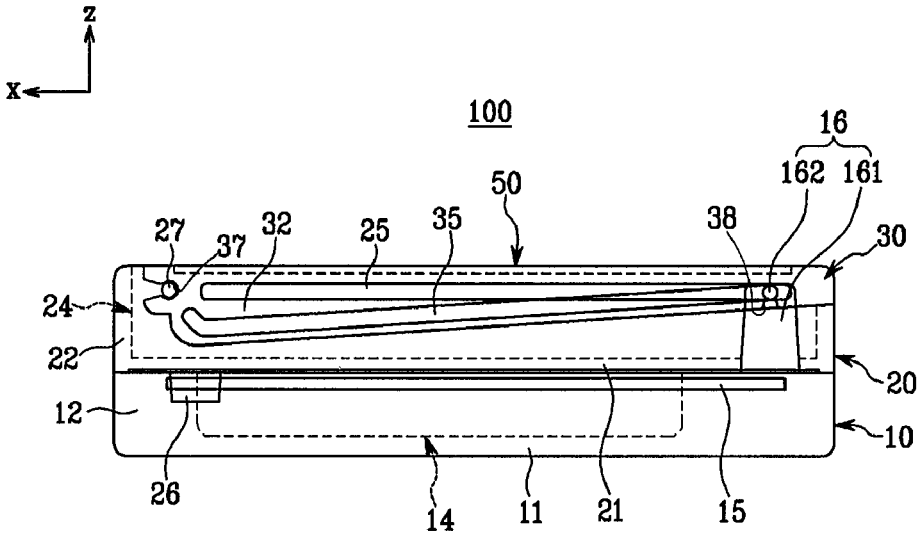
FIGS. 5 and 6 are side views of the cosmetic case of FIG. 1 in operation.
Figure 6:
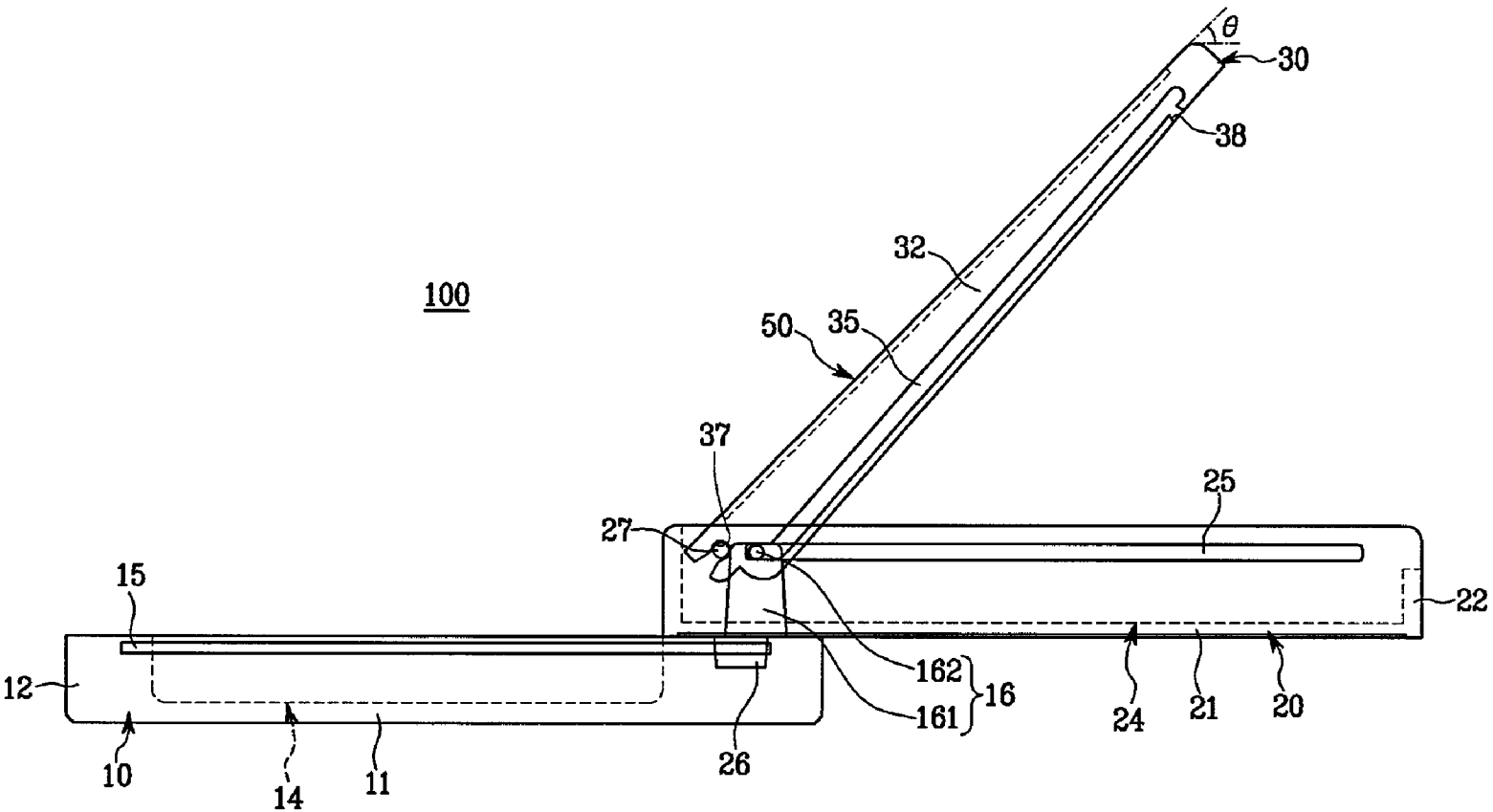

FIGS. 5 and 6 are side views of the cosmetic case 100 according to a first embodiment of the present invention.

Referring to FIGS. 5 and 6, a distance between the lift rail 35 formed at the cover sidewall 32 of the third casing 30 and the upper bottom 21 of the second casing 20 gradually changes. The distance between the lift rail 35 and upper bottom 21 is farthest at a portion farthest from the container 37. Whereas, as the lift rail 35 becomes close to the container 37, the lift rail 35 becomes more close to the upper bottom 21, is bent again near the container 37, and becomes more distant from the upper bottom 21. In this manner, by bending again a portion of the lift rail 35 at near the container 37, the third casing 30 can be stably supported when the third casing 30 is lifted to the maximum position.

According to the structure above, when the first casing 10 and the second casing 20 slide each other, and thus the first container 14 is open, the third casing 30 is lifted while rotating about the container 37, and the second container 24 is also open. In other words, when the first guide bar 16 of the first casing 10 moves along the second guide rail 25 of the second casing 20, and thus the first container 14 is open, the snag axis 162 of the first guide bar 16 moves along the lift rail 35 of the third casing 30 at the same time, and thus the second container 24 is also open. Therefore, in the cosmetic case 100 according to the present embodiment of the invention, when the first container 14 is open, the second container 24 is also open.

On the other hand, when the first guide bar 16 of the first casing 10 moves along the second guide rail 25 of the second casing 20, and thus the first container 14 is closed, the snag axis 162 of the first guide bar 16 moves along the lift rail 35 of the third casing 30 at the same time, and thus the second container 24 is also closed.

A release aperture 38 is formed at the edge portions of the lift rail 35, so that the snag axis 162 of the first guide bar 16 connected with the lift rail 35 can be released from the lift rail 35. In a state that the first container 14 is closed, the release aperture 38 is formed downwards (-Z-axis direction) at the edge portions of the lift rail 35. Further, the release aperture 38 is formed at an edge portion farthest from the container 37. In other words, the release aperture 38 is formed at the opposite position of the snag axis 162 of the first guide bar 16, in a state that the first container 14 is closed. It is possible to open the second container 24 alone by lifting the third casing 30 in a state that the first container 14 is closed. The release aperture 38 has a size sufficient to prevent the snag axis 162 from releasing. Accordingly, the third casing 30 is prevented from opening arbitrarily, and can be open only when a user exerts a force when needed.

Since the mirror 50 is attached to the front side of the cover main body 31 of the third casing 30, when the second container 24 is open, the mirror 50 is arranged to have a specific inclination angle θ. Here, the inclination angle θ of the mirror 50 is in the range of 30 to 70 degrees with respect to the upper bottom 21 of the second casing 20.

Figure 7:
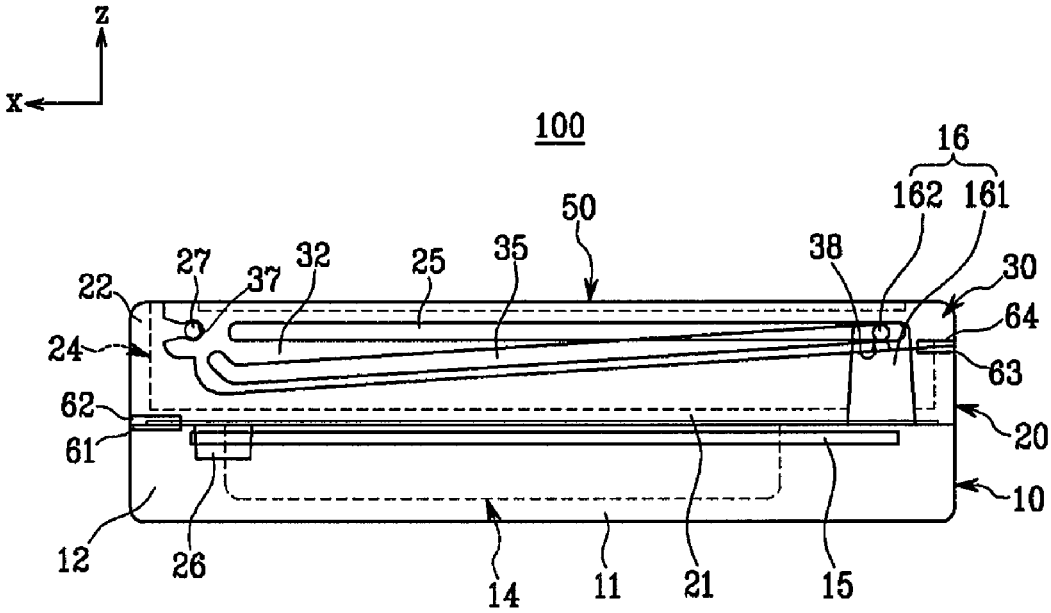
FIG. 7 is a side view of a structure of a cosmetic case according to an embodiment modified from the first embodiment of the present invention.

An embodiment modified from the first embodiment of the present invention will now be described with reference to FIG. 7. FIG. 7 is a side view of a structure of the cosmetic case 100.

Referring to FIG. 7, in a state that the first container 14 is closed, the cosmetic case 100 includes a portion of the upper bottom 21 of the second casing 20 and magnetic members 61 and 62 attached to a portion of the lower sidewall 12 of the first casing 10 facing the upper bottom 21. Here, the magnetic members 61 and 62 may be magnets. Alternatively, one of the magnetic members 61 and 62 may be a magnet, and the other thereof may be ironware or its equivalent. In the cosmetic case 100, the magnet 61 of the first casing 10 and the magnet 62 of the second casing 20 cling to each other when the first container 14 is closed, and the second casing 20 slides arbitrarily with respect to the first casing 10, thereby avoiding unnecessary opening of the first container 14. If necessary, the user may exert a force to slide the second casing 20 with respect to the first casing 10 to open the first container 14.

In addition, in a state that the second container 24 is closed, the cosmetic case 100 further includes a portion of the upper sidewall 22 of the second casing 20 and magnetic members 63 and 64 attached to a portion of the cover sidewall 32 of the third casing 30 facing the upper sidewall 22. Here, the magnetic members 63 and 64 may be magnets. Alternatively, one of the magnetic members 63 and 64 may be a magnet, and the other thereof may be ironware or its equivalent. In the cosmetic case 100, the magnet 63 of the second casing 20 and the magnet 64 of the third casing 30 third casing 30 cling to each other when the second container 24 is closed, and the third casing 30 is lifted arbitrarily, thereby avoiding unnecessary opening of the second container 24. If necessary, the user may exert a force to slide the second casing 20 with respect to the first casing 10 to open the second container 24 along with the first container 14. Alternatively, the user may open the second container 24 by lifting the third casing 30 alone in a state that the first container 14 is closed.

Figure 8:
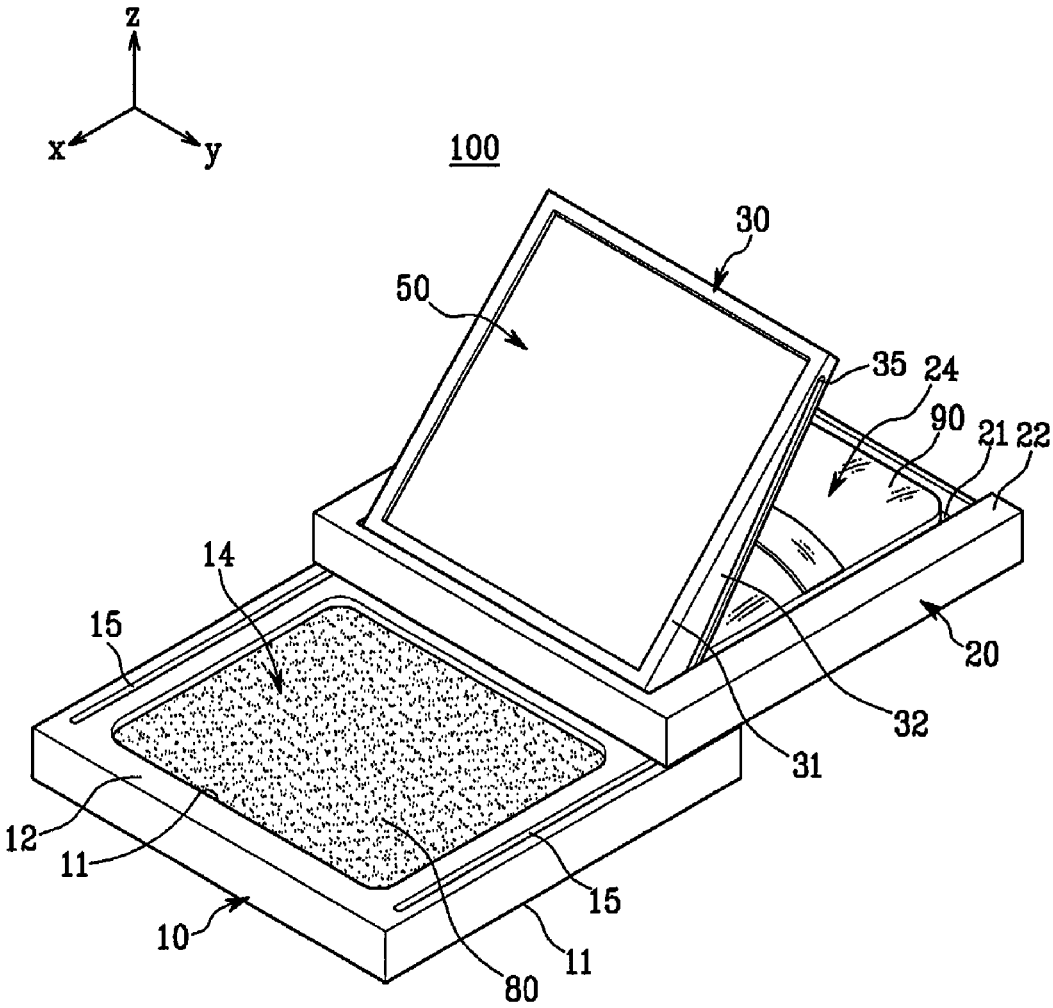
FIG. 8 is a perspective view of an example of the cosmetic case of FIG. 1 in operation.

The cosmetic case 100 according to the first embodiment of the present invention may be used as shown in FIG. 8. That is, in the cosmetic case 100, a powder 80 is contained in the first container 14, and a puff 90 is contained in the second container 24. Accordingly, when the user opens the first container 14 by sliding the second casing 20 with respect to the first casing 10, the third casing 30 is lifted at the same time, thereby opening the second container 24. When the third casing 30 is lifted, and thus the second container 24 is open, the mirror 50 attached to the front side of the third casing 30 has a specific inclination angle. As a result, the user can easily view the mirror 50 in a state that the first container 14 and the second container 24 are open.

With a simple operation, the user may open the first container 14 and the second container 24 at the same time. Further, the user may easily take the puff 90 out of the second container 24 to apply the powder 80 contained in the first container 14. Since the mirror 50 attached to the front side of the third casing 30 has a specific angle when the second container 24 is open, the user can easily wear a make-up using the powder 80 contained in the first container 14 while viewing the mirror 50.

Figure 9:
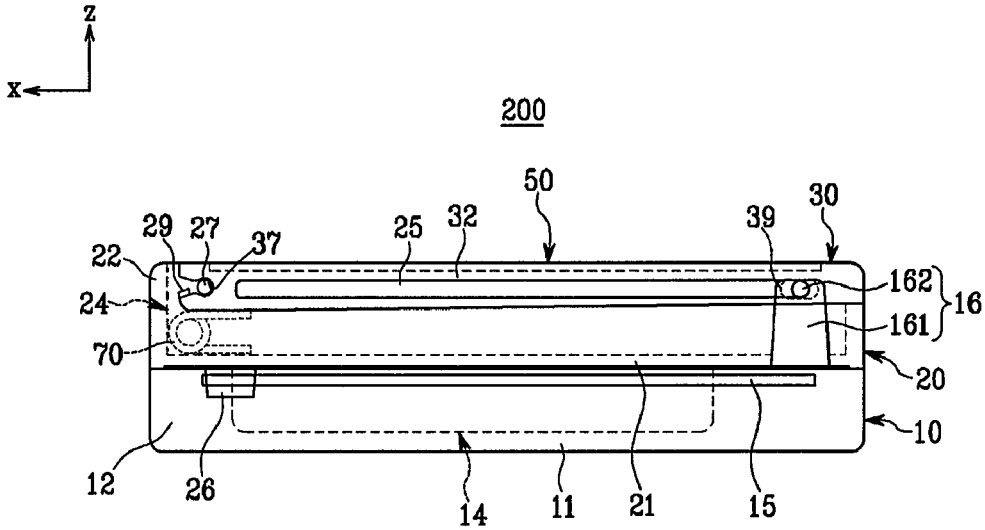
FIGS. 9 and 10 are side views of a cosmetic case in operation according to a second embodiment of the present invention.
Figure 10:
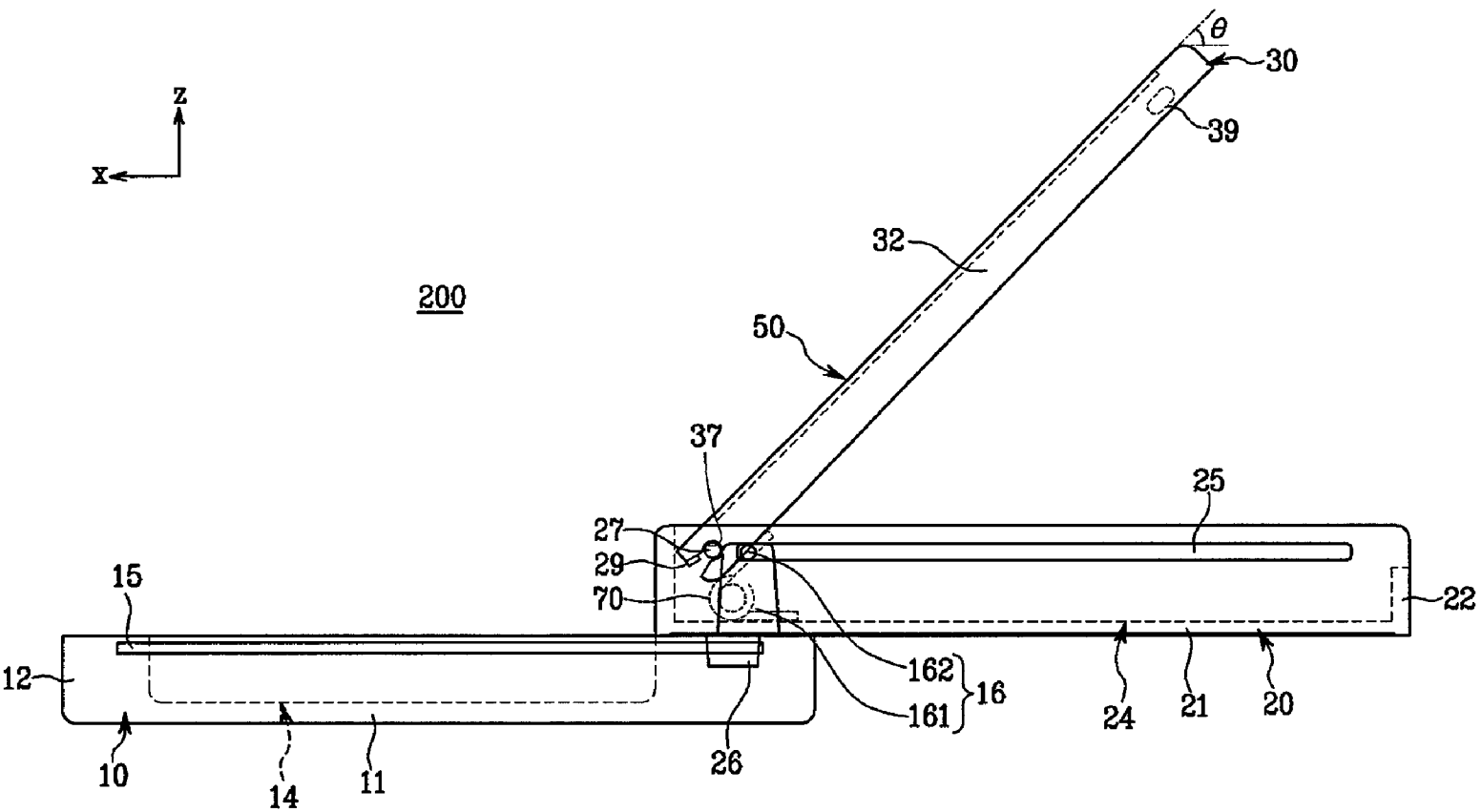

Now, a cosmetic case 200 according to a second embodiment of the present invention will be described with reference to FIGS. 9 and 10. FIGS. 9 and 10 are side views of the cosmetic case 200 in operation.

Referring to FIGS. 9 and 10, the cosmetic case 200 includes a first casing 10, a second casing 20, a third casing 30, a mirror 50, and an elastic member 70.

The first casing 10 includes a lower bottom 11, a lower sidewall 12 vertically extended from edge portions of the lower bottom 11, and a first container 14 formed by the lower bottom 11 and the lower sidewall 12.

The second casing 20 includes an upper bottom 21, an upper sidewall 22 vertically extended from edge portions of the upper bottom 21, and a second container 24 formed by the upper bottom 21 and the upper sidewall 22. Here, the second casing 20 is connected with the first casing 10 in a sliding manner. When the second casing 20 slides with respect to the first casing 10, the upper bottom 21 of the second casing 20 opens and closes the first container 14 of the first casing 10.

The third casing 30 includes a cover main body 31 (shown in FIG. 2) covering the second container 24 of the second casing 20 and a cover sidewall 32 that extends from edge portions of the cover main body 31, to be inserted into the second container 24. When the third casing 30 covers the second container 24 of the second casing 20, the outer surface of the cover sidewall 32 faces the inner surface of the upper sidewall 22. Here, when the first container 14 is open by sliding the second casing 20 with respect to the first casing 10, the third casing 30 is lifted at the same time, thereby opening the second container 24. The mirror 50 is attached to the front side of the cover main body 31 of the third casing 30.

The first casing 10 further includes a first guide rail 15 and a first guide bar 16, and the second casing 20 further includes the second guide rail 25 and the second guide bar 26. Here, the first guide bar 16 is connected with the second guide rail 25, and the second guide bar 26 is connected with the first guide rail 15. Accordingly, while the first casing 10 and the second casing 20 slide with respect to each other, the first container 14 is open and closed.

The second casing 20 further includes a pair of rotation axes 27 which face each other and are protruded from the inner lateral surface of the second container 24. The third casing 30 further includes an axis container 37 which is formed at one end of the cover sidewall 32 and is rotatably connected with the rotation axes 27 of the second casing 20. Accordingly, the third casing 30 opens and closes the second container 24 of the second casing 20, while rotating about the container 37 with respect to the rotation axes 27.

The elastic member 70 is contained in the second container 24, and pushes the second casing 20 and the third casing 30 from each other. Namely, a repulsive force is provided between the second casing 20 and the third casing 30. Here, the elastic member 70 is a torsion coil spring. The elastic member 70 is disposed near the rotation axes 27 of the second casing 20, and rotates the third casing 30 about the container 37, to be pressed in an opening direction of the second container 24.

The third casing 30 further includes a snag notch 39 formed in the cover sidewall 32 parallel to the X-axis direction at the farthest position from the container 37. Here, the snag axis 162 of the first guide bar 16 passes through the axis guide notch 252 (shown in FIG. 4) of the second guide rail 25, and is snagged by the snag notch 39 of the third casing 30 in a state that the first container 14 is closed. Accordingly, even if the elastic member 70 provides a repulsive force between the second casing 20 and the third casing 30, the second container 24 is not open when the first container is closed.

However, when the first casing 10 and the second casing 20 slide each other, and thus the first container 14 is open, the snag axis 162 also moves along the second guide rail 25. As a result, the snag axis 162 is released from the snag notch 39. Thus, due to the elastic member 70, the third casing 30 rotates about the container 37, thereby opening the second container 24.

The second casing 20 further includes a stopper 29 protruded from the inner surface of the second container 24. The stopper 29 limits the rotation of the third casing 30, and allows the third casing 30 to have a specific inclination angle θ. In other words, when the second container 24 is open, the mirror 50 attached to the front side of the third casing 30 has an inclination angle θ in the range of 30 to 70 degrees with respect to the upper bottom 21 of the second casing 20.

According to the structure above, when the first casing 10 and the second casing 20 slide each other, and thus the first container 14 is open, the third casing 30 is lifted while rotating about the container 37, and the second container 24 is also open. In other words, when the first guide bar 16 of the first casing 10 moves along the second guide rail 25 of the second casing 20, and thus the first container 14 is open, the snag axis 162 of the first guide bar 16 is released from the snag notch 39, and thus the second container 24 is also open by the elastic member 70. As a result, the user can open the first container 14 and the second container 24 at the same time with a simple operation.

Accordingly, in a cosmetic case of the present invention, a user can open and close a plurality of containers easily with a simple operation, and can wear a make-up conveniently while viewing a mirror.

Namely, a first container inside a first casing and a second container inside a second casing are open at the same time when the user pushes the second casing to be slid with respect to the first casing. Thus, the user can open and close the plurality of containers with a simple operation.

In addition, a mirror is attached to the front side of a third casing covering the second container of the second casing. Thus, the user can use the mirror not only when the user wears a cosmetic contained in the cosmetic case but also when the user desires to view the mirror alone.

In addition, when the first container and the second container are open, the third casing is lifted to have a specific inclination angle. Thus, the user can more conveniently view the mirror while wearing the cosmetic contained in the cosmetic case.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A cosmetic case comprising:

a first casing having a first container, a lower bottom, a lower sidewall vertically extended from edge portions of the lower bottom, a first guide rail, and a first guide bar;

a second casing which is connected with the first casing in a sliding manner, and opens and closes the first container, and wherein the second casing comprises a second container, an upper bottom, an upper sidewall vertically extended from edge portions of the upper bottom, a second guide rail, and a second guide bar; and a third casing which is connected with the second casing and opens and closes the second container, wherein the third casing comprises a cover main body covering the second container of the second casing and a cover sidewall that extends from edge portions of the cover main body, to be inserted into the second container, wherein a mirror is attached to a front side of the cover main body of the third casing, and wherein the third casing is connected with the second guide rail, and the second guide bar is connected with the first guide rail; and wherein, when the first container is open by sliding the second casing with respect to the first casing, the third casing is lifted at the same time, thereby opening the second container.

2. The cosmetic case of claim 1, wherein the first guide bar and the second guide bar are respectively formed at both opposite sides with respect to a direction where the first casing and the second casing slide with respect to each other.

3. The cosmetic case of claim 1, wherein the second guide bar comprises a protrusion, which is protruded from the edge portions of the upper bottom of the second casing towards the lower sidewall of the first casing, and a hook which is bent-extended from an end of the protrusion.

4. The cosmetic case of claim 3, wherein the first guide rail comprises a protrusion inserting portion through which the protrusion is inserted and a hook snag where the hook is snagged.

5. The cosmetic case of claim 1, wherein the first guide bar comprises a rod, which is protruded from the lower sidewall of the first casing towards the upper bottom of the second casing, and a snag axis which is protruded-extended from an end of the rod towards a direction normal to a lengthwise-direction of the second guide rail.

6. The cosmetic case of claim 5, wherein the second guide rail comprises a rod inserting portion through which the rod is inserted and an axis guide notch through which the snag axis is inserted.

7. The cosmetic case of claim 6, wherein the second casing further comprises a pair of rotation axes which face each other and are protruded from the inner lateral surface of the second container, and the third casing 30 further comprises an axis container which is formed at one end of the cover sidewall and is connected with the rotation axes.

8. The cosmetic case of claim 7, wherein the third casing further comprises a lift rail formed at the cover sidewall parallel with respect to the direction where the first casing and the second casing slide each other, and the snag axis of the first guide bar passes through the axis guide notch of second guide rail and is connected with the lift rail.

9. The cosmetic case of claim 8, wherein, when the first guide bar of the first casing moves along the second guide rail of the second casing, and thus the first container is open, the snag axis of the first guide bar moves along the lift rail of the third casing at the same time, and the third casing rotates about the axis container, thereby opening the second container.

10. The cosmetic case of claim 9, wherein, when the first guide bar of the first casing moves along the second guide rail of the second casing, and thus the first container is closed, the snag axis of the first guide bar moves along the lift rail of the third casing at the same time, and the third casing rotates about the axis container, thereby closing the second container.

11. The cosmetic case of claim 8, wherein a distance between the lift rail of the third casing and the upper bottom of the second casing gradually changes.

12. The cosmetic case of claim 11, wherein, in the lift rail, a portion farthest from the axis container is the farthest from the upper bottom.

13. The cosmetic case of claim 8, wherein a release aperture is formed at the edge portions of the lift rail, so that the snag axis of the first guide bar connected with the lift rail can be released from the lift rail.

14. The cosmetic case of claim 13, wherein the release aperture is formed in the lift rail at an edge portion farthest from the axis container.

15. The cosmetic case of claim 7, wherein, when the third casing rotates about the axis container, and thus the second container is open, the mirror has a specific inclination angle.

16. The cosmetic case of claim 15, wherein the mirror has an inclination angle in the range of 30 to 70 degrees with respect to the upper bottom of the second casing.

17. The cosmetic case of claim 7, further comprising an elastic member which is contained in the second container, and provides a repulsive force between the second casing and the third casing.

18. The cosmetic case of claim 17, the elastic member is a torsion coil spring.

19. The cosmetic case of claim 17, wherein the third casing further comprises a snag notch formed in the cover sidewall parallel to the direction where the first casing and the second casing slide each other, at a position farthest from the container.

20. The cosmetic case of claim 19, wherein the snag axis of the first guide bar passes through the axis guide notch of the second guide rail and is snagged by the snag notch in a state that the first container is closed, and when the first casing and the second casing slide each other, and thus the first container is open, the snag axis is released from the snag notch.

21. The cosmetic case of claim 20, wherein, when the holding axis is released from the holding notch, the third casing is lifted while rotating about the container, and the second container is open.

22. The cosmetic case of claim 21, wherein the second casing further comprises a stopper, and the stopper limits the rotation of the third casing.

23. The cosmetic case of claim 22, wherein, when the third casing rotates about the axis container, and thus the second container is open, the mirror has a specific inclination angle.

24. The cosmetic case of claim 23, wherein the mirror has an inclination angle in the range of 30 to 70 degrees with respect to the upper bottom of the second casing.

25. The cosmetic case of claim 1, wherein a first magnetic member is attached to a portion of the upper bottom of the second casing and a portion of the lower sidewall of the first casing facing the upper bottom in a state that the first container is closed.

26. The cosmetic case of claim 1, wherein a second magnetic member is attached to a portion of the upper sidewall of the second casing and a portion of the cover sidewall of the third casing facing the portion of the upper sidewall.

27. The cosmetic case of claim 1, wherein the first container contains a powder.

28. The cosmetic case of claim 1, wherein the second container contains a puff.

* * * * *

UNITED STATES PATENT AND TRADEMARK OFFICE

CERTIFICATE OF CORRECTION

PATENT NO. : 7,828,000 B2
APPLICATION NO. : 12/086931
DATED : November 9, 2010
INVENTOR(S) : Young-Joo Lee It is certified that error appears in the above-identified patent and that said Letters Patent is hereby corrected as shown below:

On the Title page, under Abstract Item (57), line 7, "open" should read --opened--
Column 1, line 14, delete "a" between "wear" and "make-up"
Column 1, line 18, delete "a" between "wear" and "make-up"
Column 1, line 19, delete "a" between "wear" and "make-up"
Column 1, line 22, "open" should read --opened--
Column 1, line 31, "open" should read --opened--
Column 1, line 39, "open" should read --opened--
Column 1, line 51, the phrase "attached to front side" should read --attached to the front side--
Column 2, lines 13-14, insert --the-- between "from" and "inner"
Column 2, line 20, the phrase "slide each" should read --slide with respect to each--
Column 2, line 62, the phrase "slide each" should read --slide with respect to each--
Column 2, line 67 - Column 3, line 1, "slide each" should read --slide with respect to each--
Column 3, line 18, "state that the" should read --state in which the--
Column 3, line 26, delete "a" between "wear" and "make-up"
Column 5, line 19, insert --the-- between "from" and "inner"
Column 5, line 46, the phrase "slide each" should read --slide with respect to each--
Column 6, line 46, delete the repeated words "third casing 30"
Column 6, line 66, "state that the" should read --state where the--
Column 7, line 7, delete "a" between "wear" and "make-up"
Column 7, line 49, "open" should read --opened--
Column 8, line 12, the phrase "slide each" should read --slide with respect to each--
Column 8, line 27, the phrase "slide each" should read --slide with respect to each--
Column 8, line 34, "open" should read --opened--

Signed and Sealed this
Twenty-third Day of October, 2012

David J. Kappos

David J. Kappos
*Director of the United States Patent and Trademark Office*

Column 8, line 40, delete “a” between “wear” and “make-up”

Column 9, line 54, the phrase “slide each” should read --slide with respect to each--

Column 9, line 56, the phrase “guide notch of second guide” should read --guide notch of the second guide--

Column 10, line 27, the phrase “the elastic member” should read --wherein the elastic member--

Column 10, line 32, the phrase “slide each” should read --slide with respect to each--

Column 10, line 38, the phrase “slide each” should read --slide with respect to each--